US008096547B1

(12) United States Patent
Huang et al.

(10) Patent No.: US 8,096,547 B1
(45) Date of Patent: Jan. 17, 2012

(54) SHEET STOPPING STRUCTURE

(75) Inventors: Wen-An Huang, Taipei (TW); Chao-Min Yang, Taipei (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 13/116,959

(22) Filed: May 26, 2011

(30) Foreign Application Priority Data

Mar. 25, 2011 (TW) ..... 100110292

(51) Int. Cl.
*B65H 3/06* (2006.01)
*B65H 3/52* (2006.01)

(52) U.S. Cl. ..... 271/117; 271/124
(58) Field of Classification Search ..... 271/117, 271/118, 124
See application file for complete search history.

(56) References Cited

U.S. PATENT DOCUMENTS

| | | | | |
|---|---|---|---|---|
| 7,516,953 | B2 * | 4/2009 | Lee | 271/117 |
| 7,543,811 | B2 * | 6/2009 | Shimamura | 271/124 |
| 7,566,052 | B2 * | 7/2009 | Hsu et al. | 271/121 |
| 7,571,905 | B2 * | 8/2009 | Kim | 271/117 |
| 7,717,415 | B2 * | 5/2010 | Kim et al. | 271/110 |

* cited by examiner

*Primary Examiner* — David H Bollinger
(74) *Attorney, Agent, or Firm* — Kirton & McConkie; Evan R. Witt

(57) ABSTRACT

A sheet stopping structure includes a sheet pick-up arm, a sheet guide casing and a sheet stopper. A receiving recess is formed in the sheet guide casing. Two sliding slots are respectively formed in two sidewalls of the receiving recess. The sheet stopper is installed in the receiving recess, and movable along the two sliding slots. When the sheet pick-up arm is in a standby position, the sheet stopper is maintained in an upright status and protruded outside the surface of the sheet guide casing. When the sheet pick-up arm is lowered to a sheet pick-up position, the sheet stopper is rotated and then stopped down within the receiving recess.

7 Claims, 10 Drawing Sheets

SHEET STOPPING STRUCTURE

FIELD OF THE INVENTION

The present invention relates to a sheet stopping structure, and more particularly to a sheet stopping structure for use in an automatic document feeder.

BACKGROUND OF THE INVENTION

Nowadays, an office machine such as a multifunction peripheral and a scanner becomes an essential electronic device in the office. For continuously feeding a stack of documents to increase the scanning speed, automatic document feeders equipped with multifunction peripherals or scanners are introduced into the market. Generally, an automatic document feeder utilizes a sheet pick-up arm for successively feeding a stack of to-be-processed paper sheets into the inner portion of the main body of the office machine, so that the paper sheets can be further processed. Before the paper sheet is fed into a sheet-feeding channel of the automatic document feeder, a sheet stopping structure is disposed at an inlet of the automatic document feeder for stopping the paper sheet from entering the sheet-feeding channel. Due to the sheet stopping structure, the possibility of simultaneously feeding two or more paper sheets into the sheet-feeding channel by the sheet pick-up arm will be minimized. Moreover, for avoiding overlap or interference between successive paper sheets during the process of feeding the paper sheets, every two consecutive paper sheets fed into the automatic document feeder should be spaced from each other by a certain spacing interval. That is, after a previous paper sheet is fed into the sheet-feeding channel, a next paper sheet is stopped at the inlet by the sheet stopping structure. After the previous paper sheet is advanced for a constant distance, the next paper sheet is allowed to be introduced into the sheet-feeding channel.

FIG. 1 is a schematic perspective view illustrating a sheet stopping structure according to the prior art. The sheet stopping structure is disclosed in Taiwanese Patent No. 1290098. As shown in FIG. 1, the sheet stopping structure 1 comprises a sheet pick-up arm 11, a rotating shaft 12 and a sheet stopper 13. The sheet pick-up arm 11 comprises a protruding block 111 and a stopping slice 112. The protruding block 111 and the stopping slice 112 are both disposed on a lateral surface of the sheet pick-up arm 11. During operations, the rotating shaft 12 may drive rotation of the sheet pick-up arm 11 to a standby position or a sheet pick-up position. As shown in FIG. 1, the sheet pick-up arm 11 is in the standby position. The sheet stopper 13 comprises a pivotal part 131, a loading part 132 and a sheet stopping part 133.

Hereinafter, a process of performing a sheet pick-up operation by the conventional sheet stopping structure will be illustrated with reference to FIGS. 2A-2F.

First of all of, as shown in FIG. 2A, the sheet pick-up operation is not performed, and the sheet pick-up arm 11 is in the standby position. Meanwhile, since the sheet stopping part 133 is engaged with the protruding block 111, the sheet stopper 13 is maintained upright and fails to be pushed forward by the paper sheet S. Under this circumstance, the paper sheet S on the sheet-feeding channel is stopped by the sheet stopper 13.

Next, as shown in FIG. 2B, the sheet pick-up operation is ready, and the sheet pick-up arm 11 is rotated to the sheet pick-up position. Meanwhile, since the protruding block 111 of the sheet pick-up arm 11 is no longer engaged with the sheet stopping part 133, the sheet stopping part 133 is not hindered by the protruding block 111 but can be freely swung.

Under this circumstance, the sheet stopping part 133 is stopped by the stopping slice 112 of the sheet pick-up arm 11, so that the sheet stopping part 133 fails to be swung toward the paper sheet S on the sheet-feeding channel. Consequently, the paper sheet S is not damaged by the sheet stopping part 133.

Then, please refer to FIGS. 2C and 2D. For performing the sheet pick-up operation, the paper sheet S is driven by the sheet pick-up arm 11 to be moved toward the internal portion of the automatic document feeder. As the paper sheet S is moved forwardly, the sheet stopping part 133 is pushed by the paper sheet S and then sunken under the sheet-feeding channel. Under this circumstance, the paper sheet S can be smoothly transported into the sheet-feeding channel without being stopped by the sheet stopping part 133.

Finally, please refer to FIGS. 2E and 2F. After the paper sheet S is completely transported across the sheet stopping part 133, the torque applied on the loading part 132 of the sheet stopper 13 will allow the sheet stopper 13 to be rotated about the pivotal part 131, so that the sheet stopping part 133 will be returned to the upright status. After the sheet pick-up operation is finished, the sheet pick-up arm 11 is lifted to the standby position, and the sheet stopping part 133 is engaged with the protruding block 111 again. Under this circumstance, the sheet stopping part 133 fails to be freely swung, so that other paper sheets S on the sheet-feeding channel will be continuously stopped by the sheet stopping part 133.

From the above discussions, the sheet stopping structure 1 is capable of stopping the paper sheets from entering the sheet-feeding channel by utilizing the sheet stopper 13 which can be engaged with the sheet pick-up arm 11.

The conventional sheet stopping structure 1, however, still has some drawbacks. For example, as previously described, the sheet stopping function is achieved only when the sheet stopping part 133 of the sheet stopper 13 is engaged with the protruding block 111 of the sheet pick-up arm 11. If the sheet stopping structure 1 is used for a long time period, the sheet stopper 13 is possibly suffered from deformation. Due to the deformation of the sheet stopper 13, the sheet stopping part 133 fails to be engaged with the protruding block 111 of the sheet pick-up arm 11, and thus the sheet stopping function of the sheet stopper 13 is lost. Under this circumstance, the use of the sheet stopping structure 1 may result in a multi-feeding problem of simultaneously feeding two or more paper sheets. For solving the multi-feeding problem, the sheet stopper 13 should be replaced with a new one. In other words, the conventional sheet stopping structure 1 is not user-friendly.

Therefore, there is a need of providing an improved sheet stopping structure so as to obviate the drawbacks encountered from the prior art.

SUMMARY OF THE INVENTION

The present invention provides a sheet stopping structure with minimized possibility of losing effectiveness through self-deformation and reduced layout space.

In accordance with an aspect of the present invention, there is provided a sheet stopping structure for use in an automatic document feeder. The sheet stopping structure includes a sheet pick-up arm, a sheet guide casing and a sheet stopper. The sheet pick-up arm is selectively rotated to a standby position or a sheet pick-up position. The sheet pick-up arm has a protruding block on a lateral surface thereof. When the sheet pick-up arm is located at the sheet pick-up position, the sheet pick-up arm is permitted to perform a sheet pick-up operation. The sheet guide casing includes a receiving recess. The receiving recess is disposed under the sheet pick-up arm and includes a first sidewall, a second sidewall and two sliding slots. The two sliding slots are formed in the first sidewall and the second sidewall, respectively. The sheet stopper is disposed under the protruding block of the sheet pick-up arm and includes two protrusion shafts. The two protrusion shafts are arranged at bilateral sides of the sheet stopper and penetrated through the two sliding slots, respectively, so that the sheet stopper is movable upwardly and downwardly along the sliding slots.

In an embodiment, each of the protrusion shafts is separated from a bottom edge of the sheet stopper by a specified spacing interval.

In an embodiment, the receiving recess further includes a third sidewall. The third sidewall is perpendicular to the first sidewall and the second sidewall. A notch is arranged at a bottom of the third sidewall.

In an embodiment, the sheet stopping structure further includes two positioning hooks, which are respectively disposed at outer sides of the two sliding slots. When the sheet stopper is moved to bottoms of the two sliding slots, the two protrusion shafts are respectively supported by the two positioning hooks.

In an embodiment, the receiving recess further includes two fixing posts, which are respectively perpendicular to the first sidewall and the second sidewall. Moreover, a through-hole is formed in a bottom of the receiving recess.

In an embodiment, the sheet stopping structure further includes an elastic element, which is sheathed around the two fixing posts. A first side of the elastic element is protruded out of the bottom of the receiving recess. A second side of the elastic element is disposed under the two protrusion shafts of the sheet stopper.

In an embodiment, the elastic element is a double-torsion spring. Moreover, the second side of the double-torsion spring includes two torsion spring arms, which are parallel with each other.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention provides a sheet stopping structure. The sheet stopping structure may be applied to an office machine for feeding paper sheets.

Figure 1:
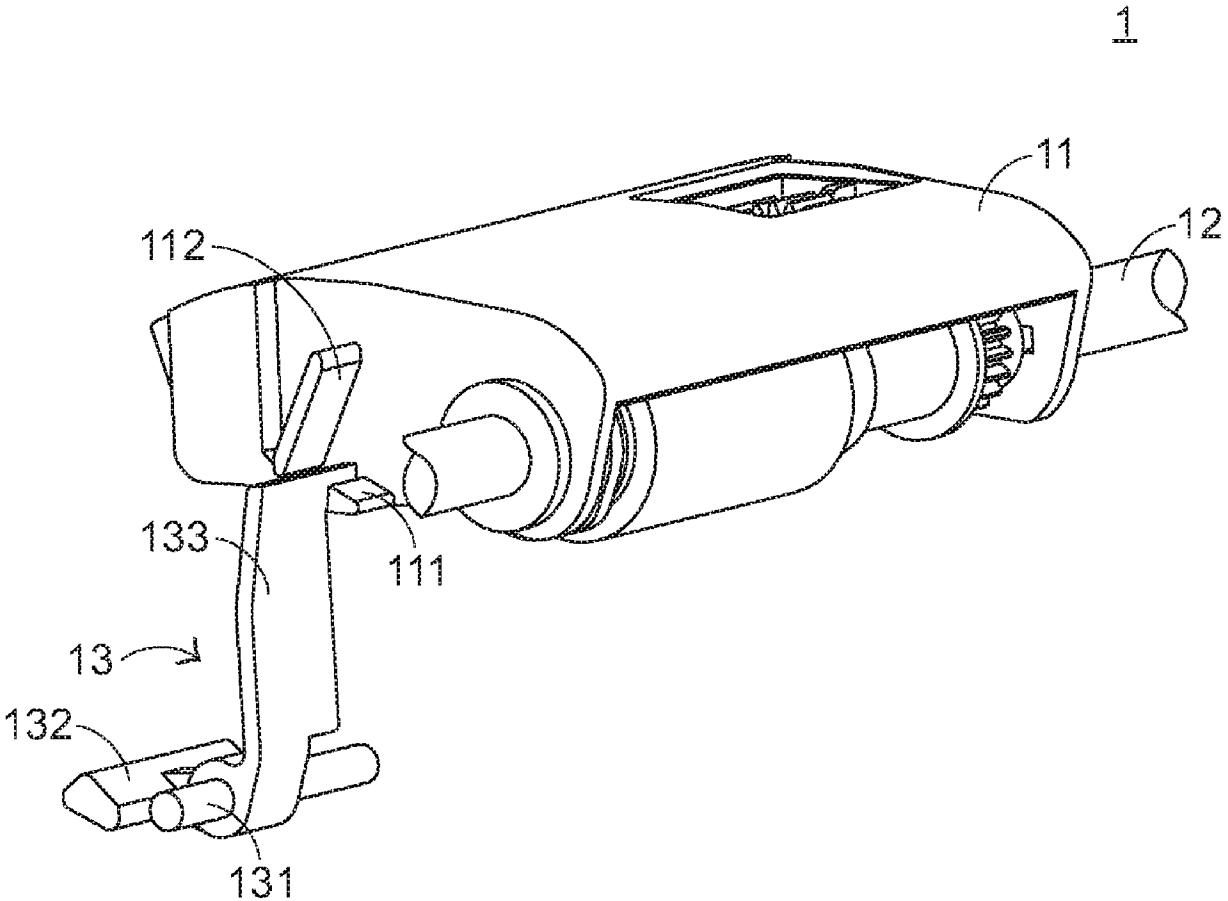
FIG. 1 PRIOR ART
FIG. 1 is a schematic perspective view illustrating a sheet stopping structure according to the prior art.
Figure 2A:
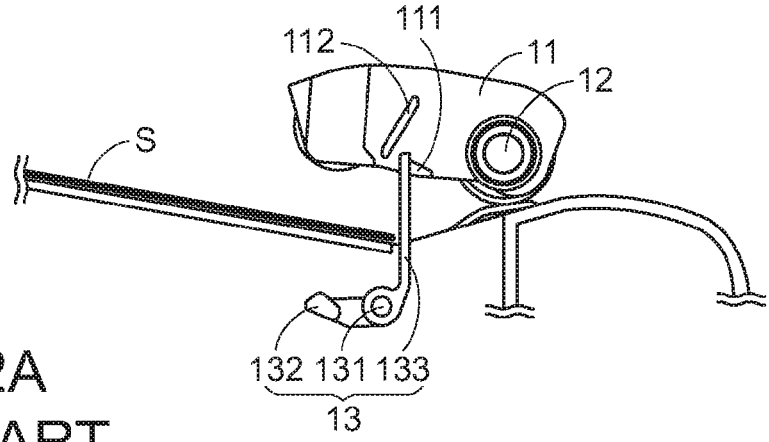
FIG.2A PRIOR ART
FIGS. 2A-2F schematically illustrates a process of performing a sheet pick-up operation by the conventional sheet stopping structure.
Figure 2B:
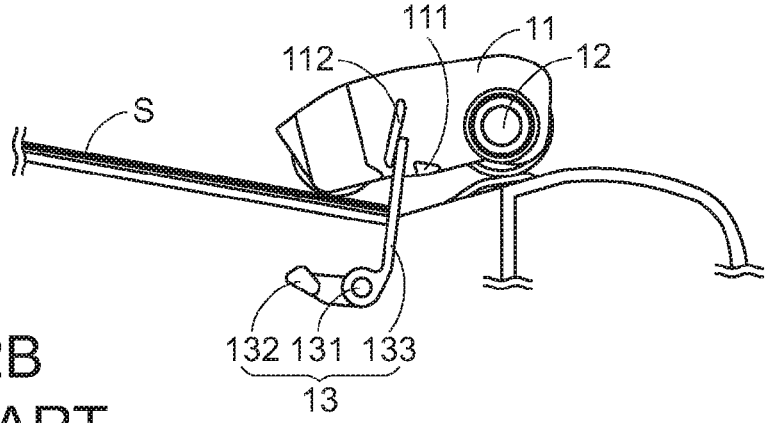
FIG.2B PRIOR ART
Figure 2C:
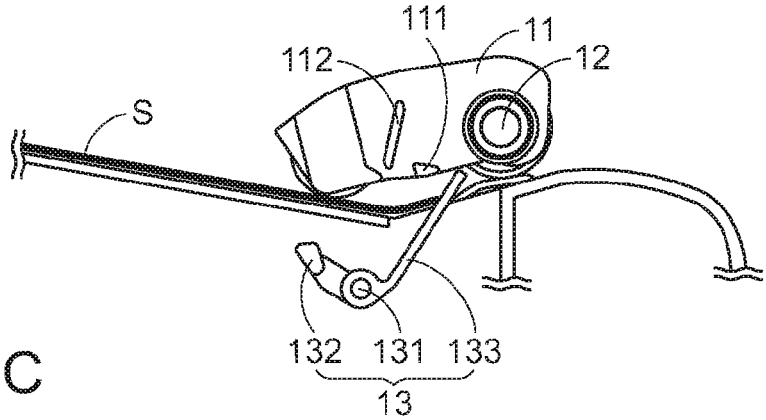
FIG.2C PRIOR ART
Figure 2D:
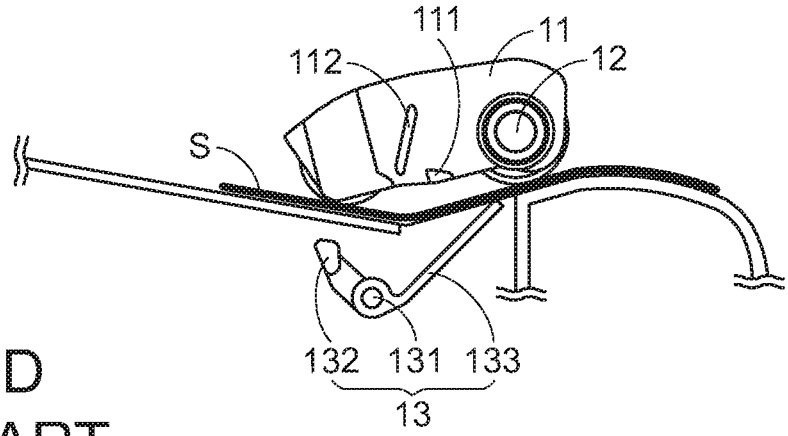
FIG.2D PRIOR ART
Figure 2E:
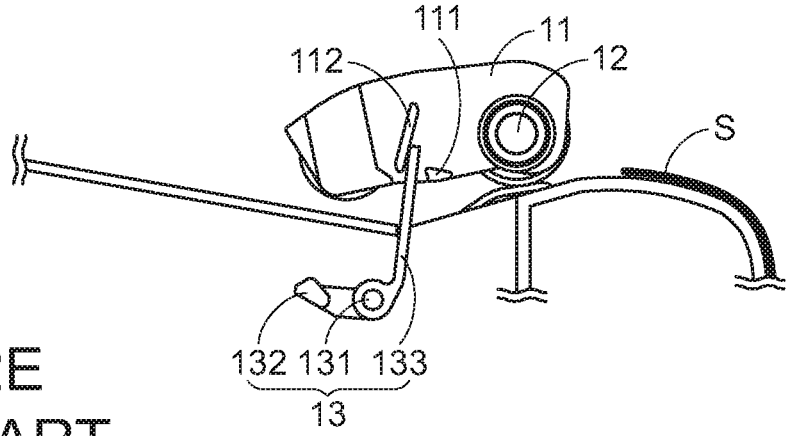
FIG.2E PRIOR ART
Figure 2F:
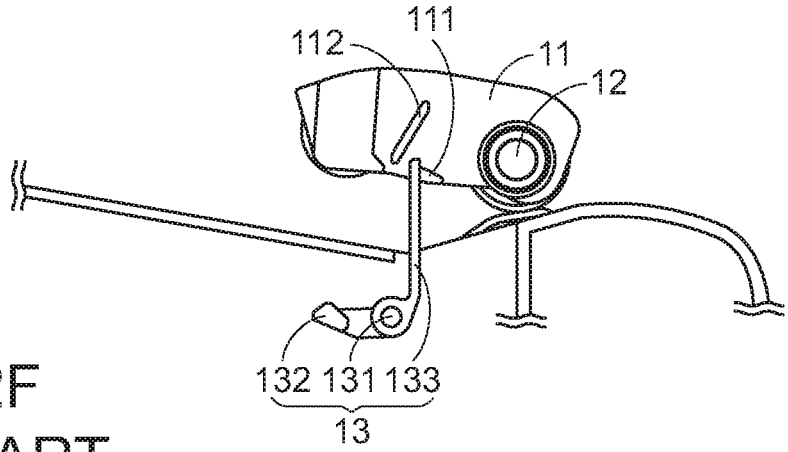
FIG.2F PRIOR ART
Figure 3A:
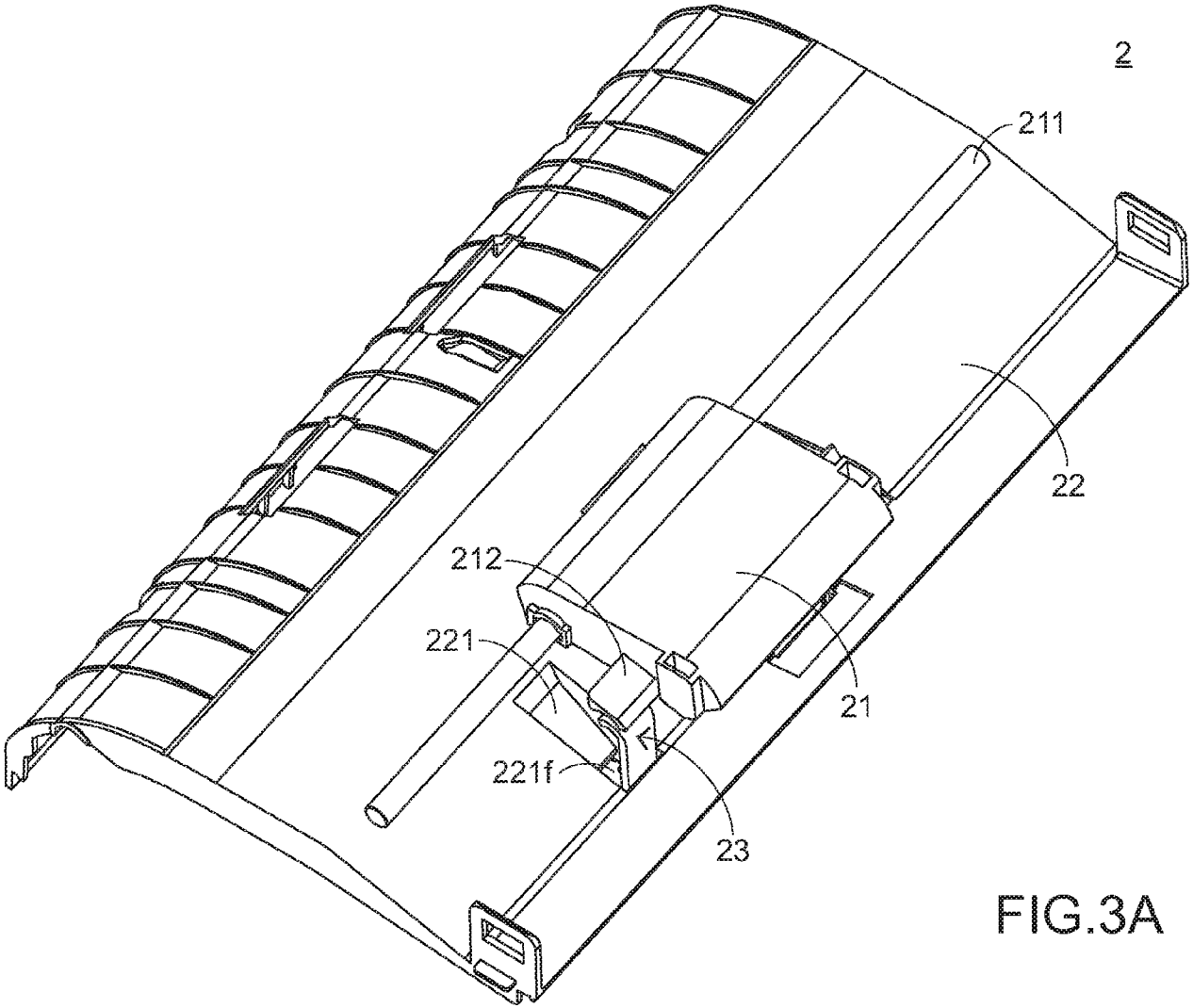
FIG. 3A is a schematic perspective view illustrating a sheet stopping structure according to an embodiment of the present invention.
Figure 3B:
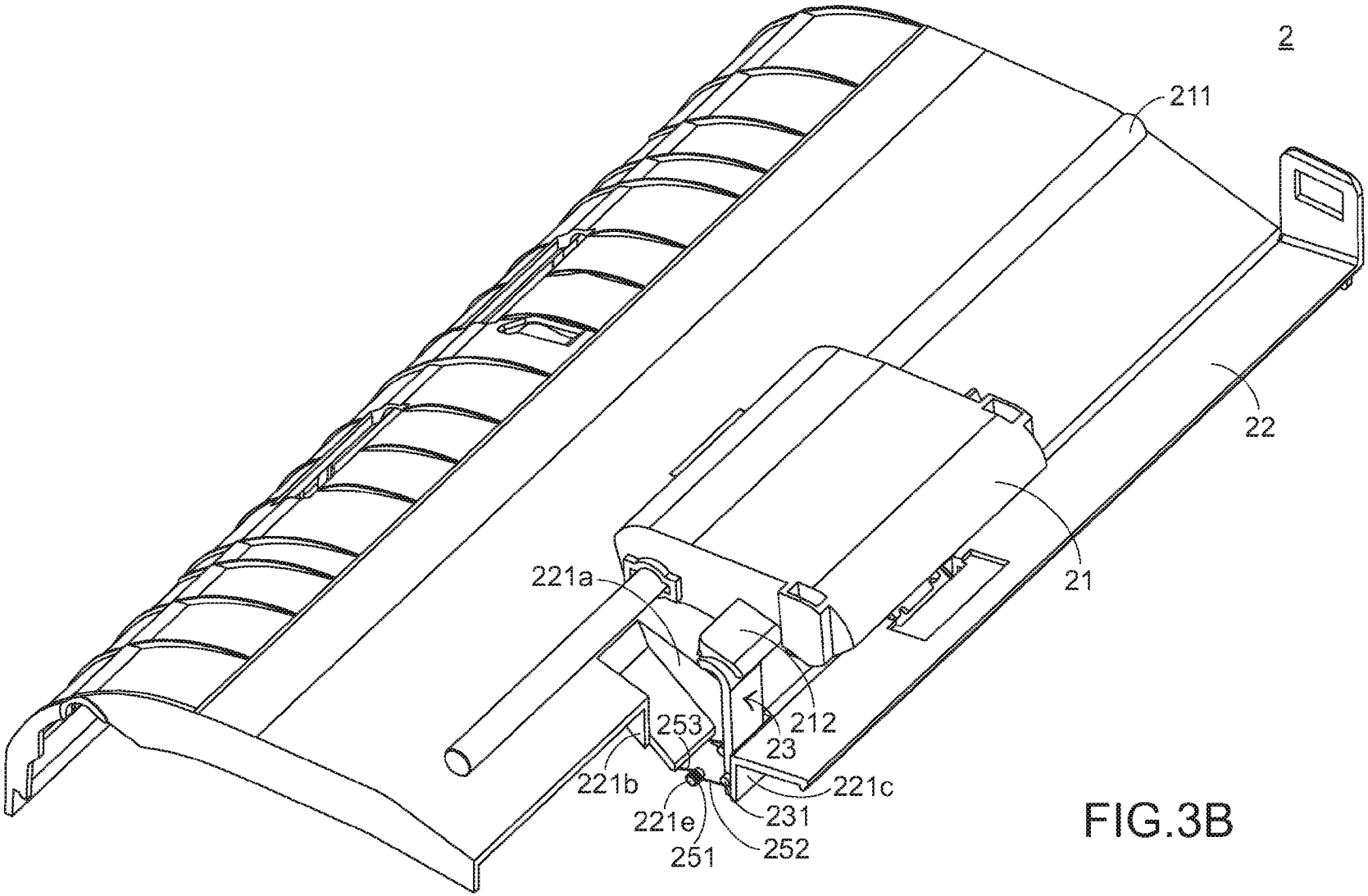
FIG. 3B is a schematic cutaway view illustrating the sheet stopping structure of FIG. 3A.

FIG. 3A is a schematic perspective view illustrating a sheet stopping structure according to an embodiment of the present invention. FIG. 3B is a schematic cutaway view illustrating the sheet stopping structure of FIG. 3A. As shown in FIGS. 3A and 3B, the sheet stopping structure 2 comprises a sheet pick-up arm 21, a sheet guide casing 22 and a sheet stopper 23.

Figure 4A:
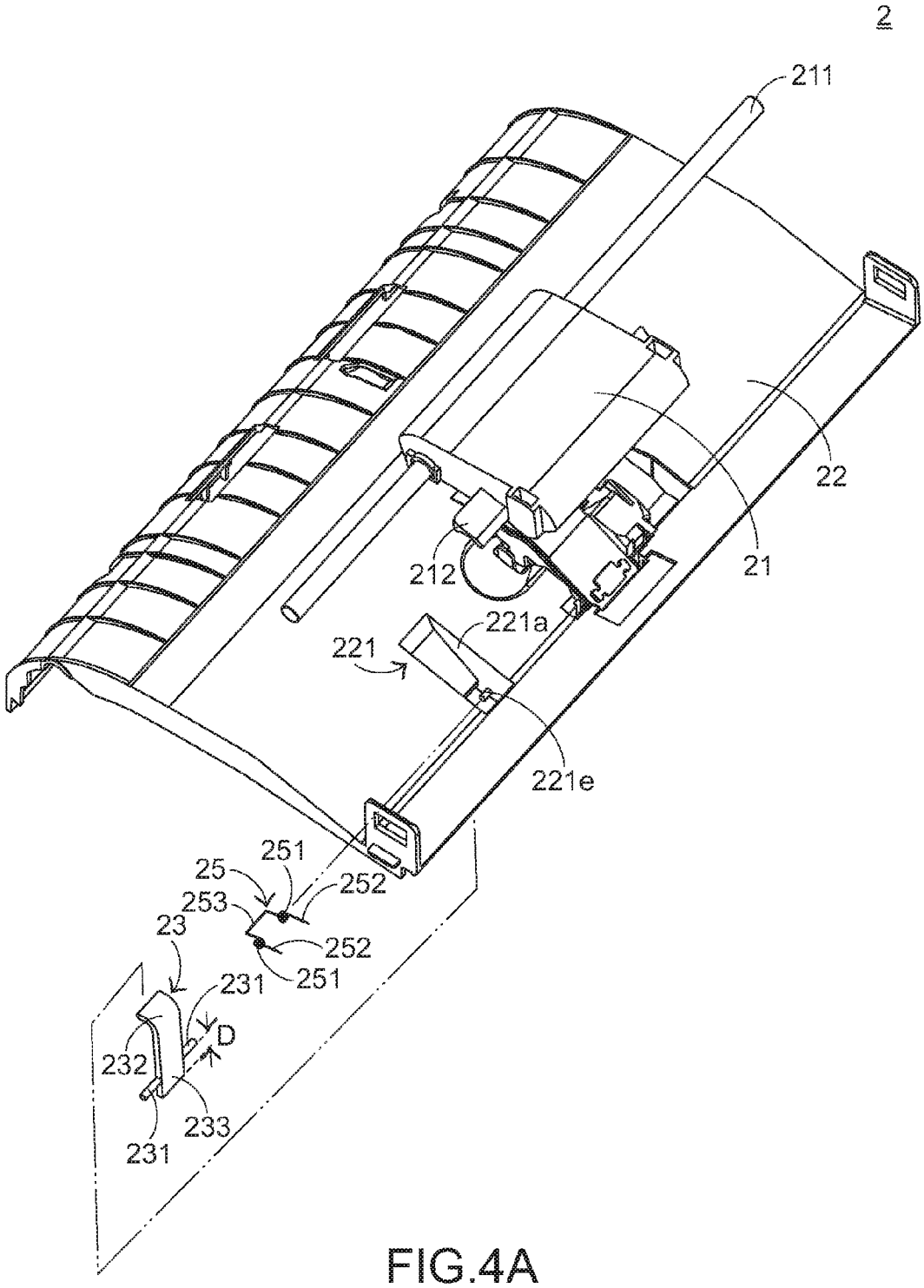
FIG. 4A is a schematic top view illustrating the front side of the sheet guide casing of the sheet stopping structure according to an embodiment of the present invention.
Figure 4B:
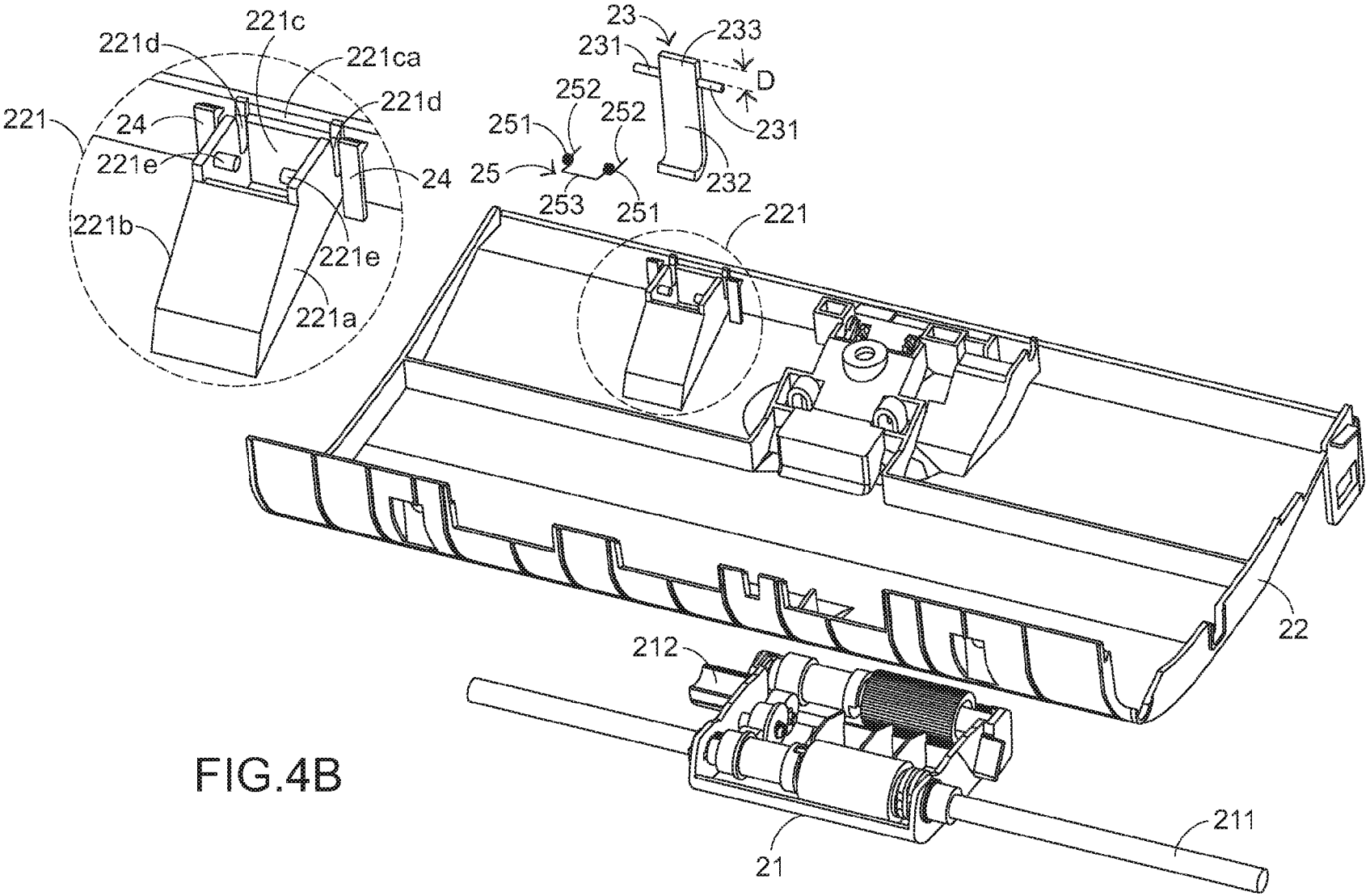
FIG. 4B is a schematic rear view illustrating the rear side of the sheet guide casing of the sheet stopping structure according to an embodiment of the present invention.

FIG. 4A is a schematic top view illustrating the front side of the sheet guide casing 22 of the sheet stopping structure according to an embodiment of the present invention. FIG. 4B is a schematic rear view illustrating the rear side of the sheet guide casing 22 of the sheet stopping structure according to an embodiment of the present invention. Please refer to FIGS. 4A and 4B. The sheet pick-up arm 21 comprises a rotating shaft 211 and a protruding block 212. The sheet guide casing 22 comprises a receiving recess 221. The receiving recess 221 comprises a first sidewall 221*a*, a second sidewall 221*b*, a third sidewall 221*c*, two sliding slots 221*d*, two fixing posts 221*e* and a through-hole 221*f* (see FIG. 3A). The sheet stopper 23 comprises two protrusion shafts 231. The sheet stopping structure 2 further comprises two positioning hooks 24 and an elastic element 25. The elastic element 25 comprises two helical parts 251, two first torsion spring arms 252 and a second torsion spring arm 253, wherein the two first torsion spring arms 252 are parallel with each other.

A sequence of assembling the sheet stopping structure according to an embodiment of the present invention will be illustrated in more details as follows. After the rotating shaft 211 is sheathed by the sheet pick-up arm 21, the sheet pick-up arm 21 is disposed over the sheet guide casing 22, wherein the protruding block 212 is arranged on a lateral surface of the sheet pick-up arm 21. The receiving recess 221 is formed in the sheet guide casing 22 and disposed under the protruding block 212 of the sheet pick-up arm 21. The first sidewall 221*a* and the second sidewall 221*b* of the receiving recess 221 are opposed to each other. The two sliding slots 221*d* are formed in the first sidewall 221*a* and the second sidewall 221*b*, respectively. The third sidewall 221*c* is perpendicular to the first sidewall 221*a* and the second sidewall 221*b*. In addition, the third sidewall 221*c* has a notch 221*ca*, which is arranged at the bottom of the third sidewall 221*c*. The two fixing posts 221*e* are perpendicular to the inner surfaces of the first sidewall 221*a* and the second sidewall 221*b*, respectively. The through-hole 221*f* is formed in the bottom of the receiving recess 221. The sheet stopper 23 is disposed under the sheet pick-up arm 21. The two protrusion shafts 231 are arranged at bilateral sides of the sheet stopper 23. In addition, the protrusion shaft 231 is separated from a bottom edge of the sheet stopper 23 by a specified spacing interval D. By the protrusion shafts 231, the sheet stopper 23 is divided into an upper portion 232 and a lower portion 233. These two protrusion shafts 231 are penetrated through the two sliding slots 221*d*, respectively. The two positioning hooks 24 are disposed at outer sides of the two sliding slots 221*d*, respectively. The two helical parts 251 of the elastic element 25 are respectively sheathed around the two fixing posts 221*e*. The second torsion spring arm 253 is protruded out of the bottom of the receiving recess 221. The two first torsion spring arms 252 are respectively disposed under the two protrusion shafts 231 of the sheet stopper 23. In this embodiment, the elastic element 25 is a double-torsion spring.

Figure 5A:
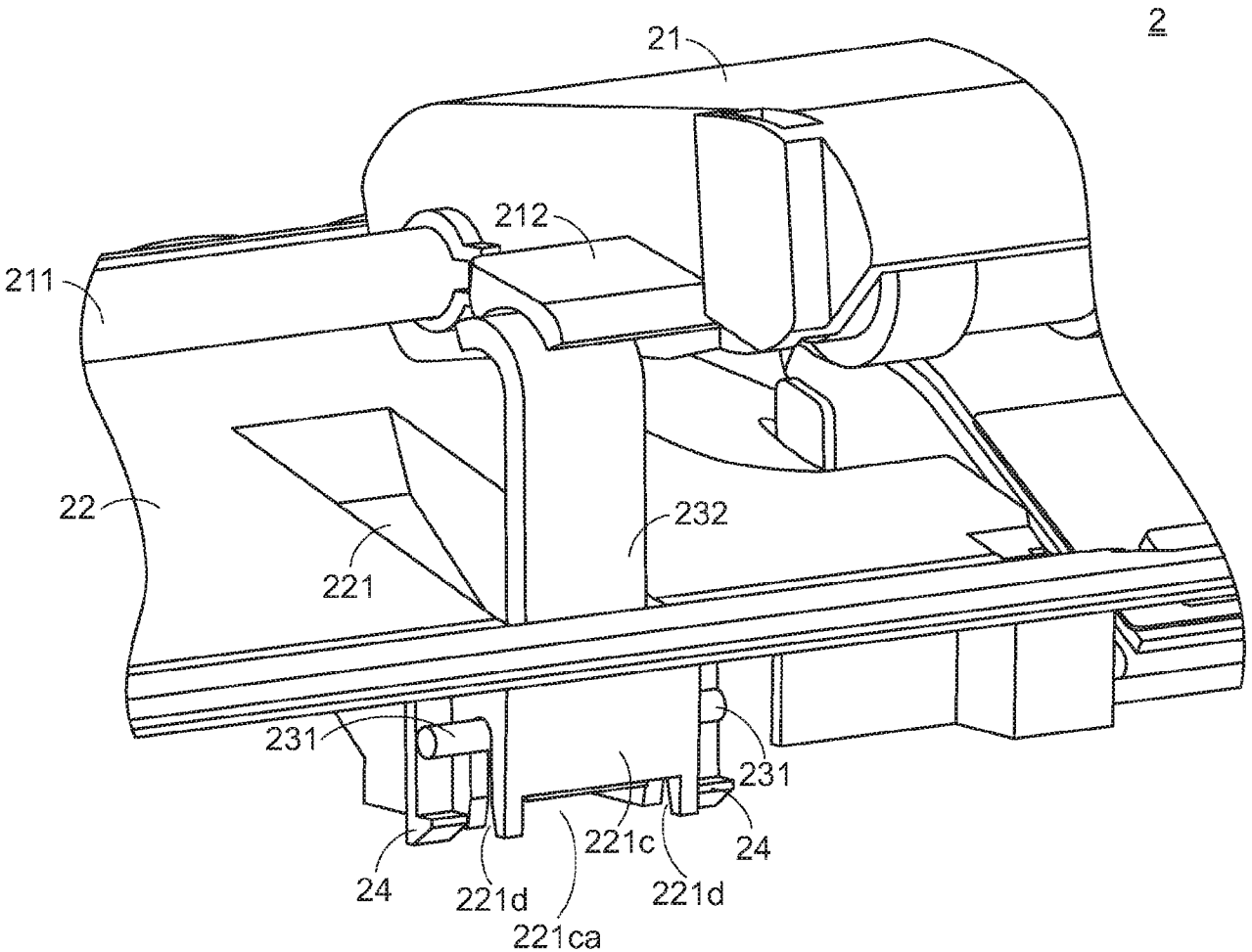
FIG. 5A is a schematic perspective view illustrating the sheet stopping structure according to an embodiment of the present invention, in which the sheet pick-up operation is not performed.
Figure 5B:
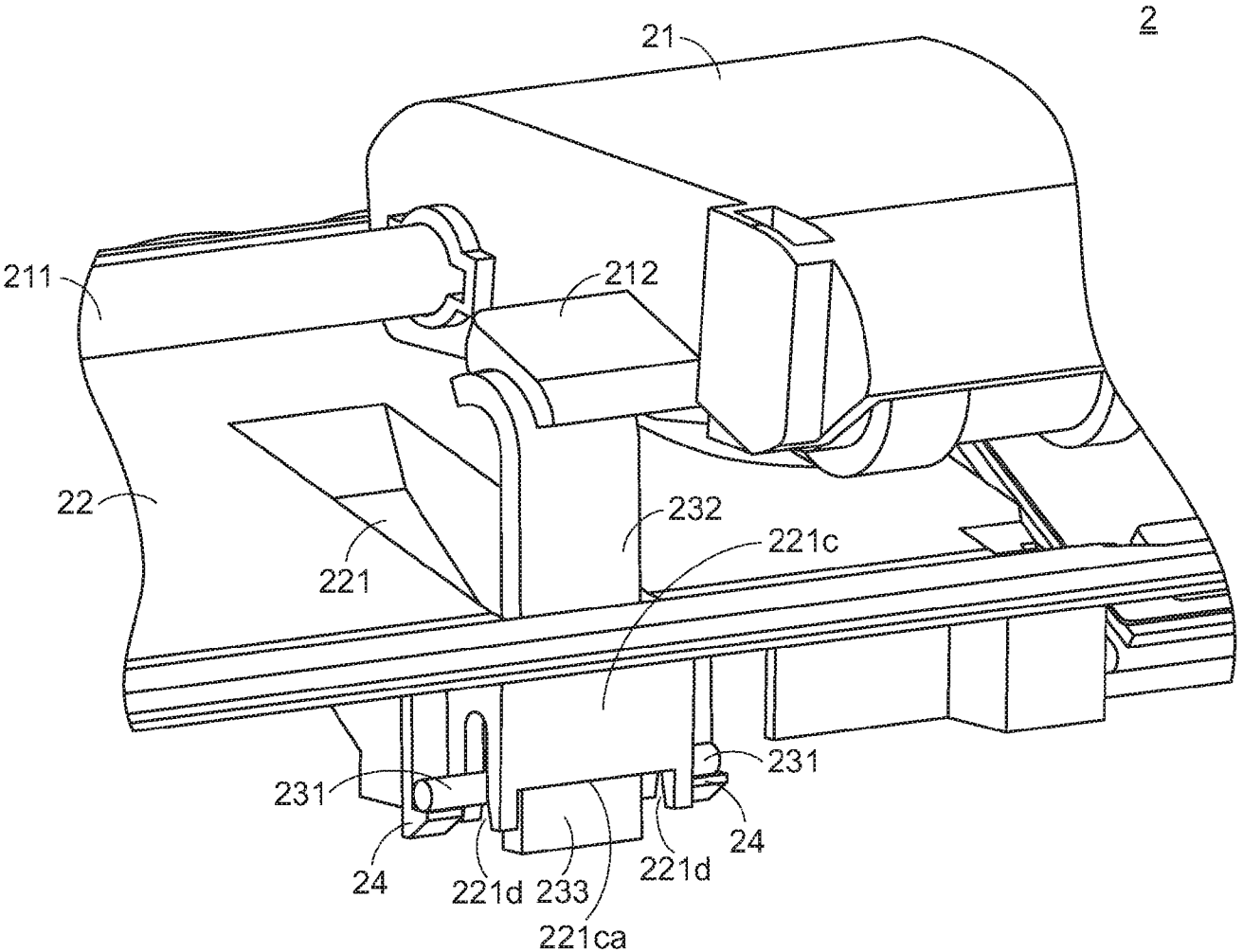
FIG. 5B is a schematic perspective view illustrating the sheet stopping structure according to an embodiment of the present invention, in which the sheet pick-up operation is ready.
Figure 5C:
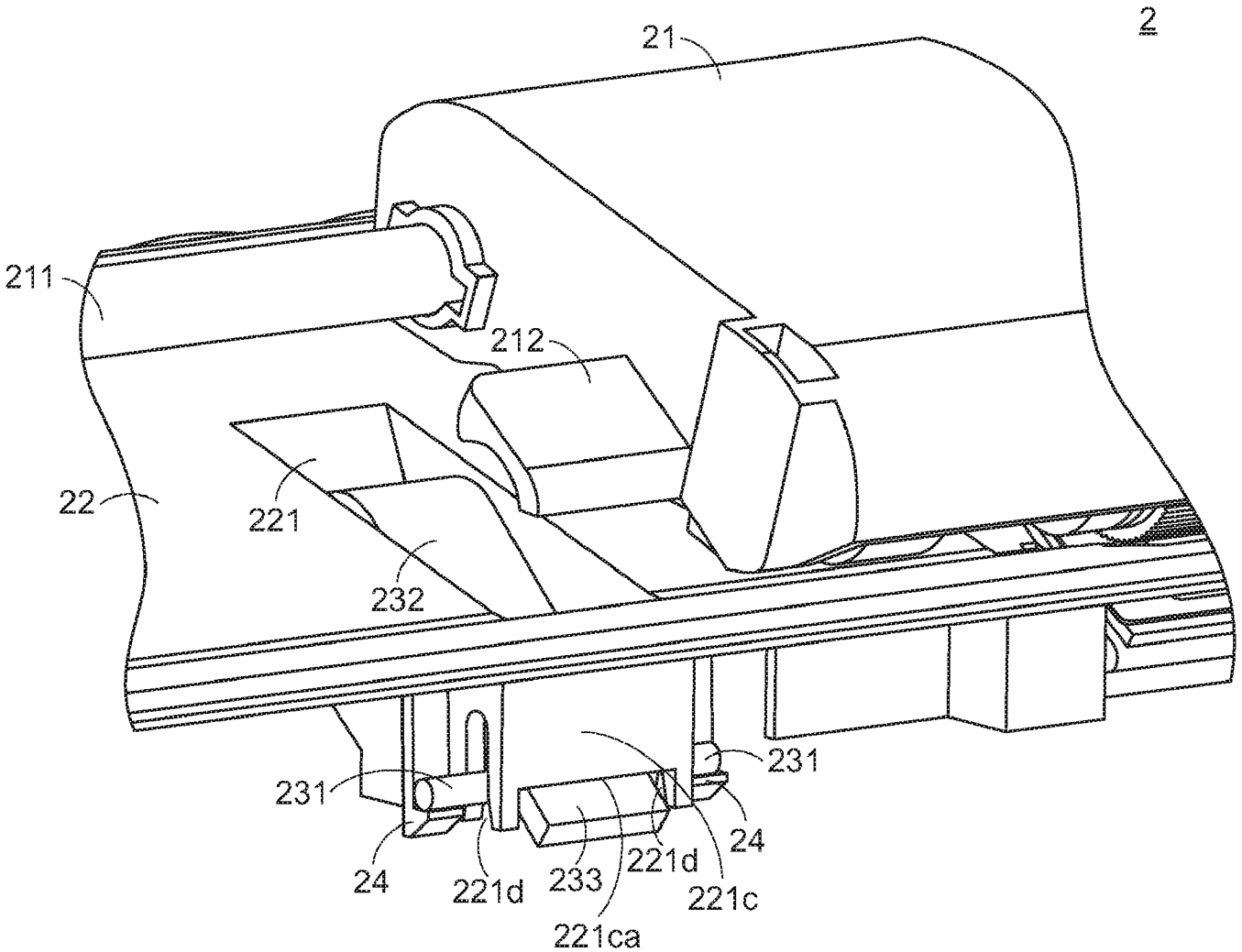
FIG. 5C is a schematic perspective view illustrating the sheet stopping structure according to an embodiment of the present invention, in which the sheet pick-up operation is performed.

Hereinafter, the operating principles of the sheet stopping structure will be illustrated with reference to FIGS. 5A, 5B and 5C. FIG. 5A is a schematic perspective view illustrating the sheet stopping structure according to an embodiment of the present invention, in which the sheet pick-up operation is not performed. FIG. 5B is a schematic perspective view illustrating the sheet stopping structure according to an embodiment of the present invention, in which the sheet pick-up operation is ready. FIG. 5C is a schematic perspective view illustrating the sheet stopping structure according to an embodiment of the present invention, in which the sheet pick-up operation is performed.

As shown in FIG. 5A, the sheet pick-up operation is not performed, and the sheet pick-up arm 21 is driven by the rotating shaft 211 to be rotated to a standby position. Meanwhile, an upward supporting force provided by the two first torsion spring arms 252 of the elastic element 25 is exerted on the two protrusion shafts 231 of the sheet stopper 23. Consequently, the two protrusion shafts 231 are moved to the top ends of the two sliding slots 221*d*, the upper portion 232 of the sheet stopper 23 is protruded outside the surface of the sheet guide casing 22, and the lower portion 233 of the sheet stopper 23 is accommodated within the receiving recess 221 and tightly contacted with the third sidewall 221*c*. When the front edge of the paper sheet is sustained against the upper portion 232 of the sheet stopper 23, the lower portion 233 of the sheet stopper 23 is stopped by the third sidewall 221*c* of the receiving recess 221 from being moved. Consequently, the sheet stopper 23 fails to be rotated about the two protrusion shafts 231. Under this circumstance, since the sheet stopper 23 is not pushed by the paper sheet, the sheet stopper 23 is maintained in the upright status to stop the paper sheet from entering the internal portion of the sheet guide casing 22.

As shown in FIG. 5B, the sheet pick-up operation is ready to be performed, and the sheet pick-up arm 21 is driven by the rotating shaft 211 to be moved downwardly. Meanwhile, the protruding block 212 of the sheet pick-up arm 21 is moved downwardly to suppress the sheet stopper 23. Consequently, the two protrusion shafts 231 of the sheet stopper 23 are moved downwardly along the two sliding slots 221*d* until the two protrusion shafts 231 are contacted with the two positioning hooks 24. Under this circumstance, the lower portion 233 of the sheet stopper 23 is no longer stopped by the third sidewall 221*c* of the receiving recess 221, and the notch 221*ca* at the bottom of the third sidewall 221*c* provides a rotatable space of the sheet stopper 23.

As the sheet pick-up arm 21 is continuously moved downwardly, the sheet stopper 23 is rotated about the two protrusion shafts 231 in a direction toward the receiving recess 221. When the sheet pick-up arm 21 is lowered to a sheet pick-up position and the sheet pick-up operation starts (see FIG. 5C), the sheet stopper 23 is toppled down within the receiving recess 221. Under this circumstance, the sheet stopper 23 is no longer maintained in the upright status, so that the paper sheet is allowed to be transported across the sheet guide casing 22 and then fed into the internal portion of the automatic document feeder 2.

After the sheet pick-up operation is finished, the sheet pick-up arm 21 is driven by the rotating shaft 211 again to be lifted to the standby position. Due to the restoring force of the elastic element 25, the sheet stopper 23 is returned to the upright status and protruded outside the surface of the sheet guide casing 22 to stop the paper sheet from entering the internal portion of the sheet guide casing 22.

From the above description, by the sheet pick-up arm 21, the receiving recess 221 of the sheet guide casing 22 and the sheet stopper 23 of the sheet stopping structure 2 of the present invention, the sheet stopper 23 may be maintained in the upright status and protruded outside the surface of the sheet guide casing 22 to stop the paper sheet from entering the sheet-feeding channel. Since it is not necessary to install an engaging structure between the sheet pick-up arm 21 and the sheet stopper 23, the possibility of losing effectiveness by deforming the sheet stopper 23 will be minimized and the sheet stopping function of the sheet stopper 23 can be prolonged. Moreover, after the sheet stopper 23 has been moved for a specified distance, the two protrusion shafts 231 are confined by the two positioning hooks 24, and thus the sheet stopper 23 fails to be continuously moved downwardly. In such way, the requisite height of the receiving recess 221 is smaller than the length of the sheet stopper 23. Moreover, after the sheet stopper 23 is rotated about the two protrusion shafts 231, since the upper portion 222 of the sheet stopper 23 will be toppled down within the receiving recess 221, only a small space at the bottom of the receiving recess 221 is required for rotating the lower portion 233 of the sheet stopper 23. In other words, since the layout space of the sheet stopping structure 2 of the present invention is reduced, the overall design of the sheet stopping structure 2 has the benefits of small size and light weightiness.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A sheet stopping structure for use in an automatic document feeder, said sheet stopping structure comprising:

a sheet pick-up arm selectively rotated to a standby position or a sheet pick-up position, wherein said sheet pick-up arm has a protruding block on a lateral surface thereof, wherein when said sheet pick-up arm is located at said sheet pick-up position, said sheet pick-up arm is permitted to perform a sheet pick-up operation;

a sheet guide casing comprising a receiving recess, wherein said receiving recess is disposed under said sheet pick-up arm and comprises a first sidewall, a second sidewall and two sliding slots, wherein said two sliding slots are formed in said first sidewall and said second sidewall, respectively; and a sheet stopper disposed under said protruding block of said sheet pick-up arm and comprising two protrusion shafts, wherein said two protrusion shafts are arranged at bilateral sides of said sheet stopper and penetrated through said two sliding slots, respectively, so that said sheet stopper is movable upwardly and downwardly along said sliding slots.

2. The sheet stopping structure according to claim 1 wherein each of said protrusion shafts is separated from a bottom edge of said sheet stopper by a specified spacing interval.

3. The sheet stopping structure according to claim 1 wherein said receiving recess further comprises a third sidewall, wherein said third sidewall is perpendicular to said first sidewall and said second sidewall, and a notch is arranged at a bottom of said third sidewall.

4. The sheet stopping structure according to claim 1 further comprising two positioning hooks, which are respectively disposed at outer sides of said two sliding slots, wherein when said sheet stopper is moved to bottoms of said two sliding slots, said two protrusion shafts are respectively supported by said two positioning hooks.

5. The sheet stopping structure according to claim 1 wherein said receiving recess further comprises two fixing posts, which are respectively perpendicular to said first sidewall and said second sidewall, wherein a through-hole is formed in a bottom of said receiving recess.

6. The sheet stopping structure according to claim 5 further comprising an elastic element, which is sheathed around said two fixing posts, wherein a first side of said elastic element is protruded out of said bottom of said receiving recess, and a second side of said elastic element is disposed under said two protrusion shafts of said sheet stopper.

7. The sheet stopping structure according to claim 6 wherein said elastic element is a double-torsion spring, and said second side of said double-torsion spring comprises two torsion spring arms, which are parallel with each other.

* * * * *